US009229399B2

(12) United States Patent
Kamihara et al.

(10) Patent No.: US 9,229,399 B2
(45) Date of Patent: Jan. 5, 2016

(54) IMAGE FORMING APPARATUS AND METHOD HAVING A FORCIBLE TONER CONSUMPTION PROCESS

(71) Applicants: Kazuaki Kamihara, Ibaraki (JP); Toshihiro Sugiyama, Ibaraki (JP); Takuma Higa, Ibaraki (JP); Masayoshi Nakayama, Ibaraki (JP); Hiroyuki Kunii, Ibaraki (JP); Masaki Sukesako, Ibaraki (JP); Wakana Itoh, Kanagawa (JP)

(72) Inventors: Kazuaki Kamihara, Ibaraki (JP); Toshihiro Sugiyama, Ibaraki (JP); Takuma Higa, Ibaraki (JP); Masayoshi Nakayama, Ibaraki (JP); Hiroyuki Kunii, Ibaraki (JP); Masaki Sukesako, Ibaraki (JP); Wakana Itoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/561,599

(22) Filed: Dec. 5, 2014

(65) Prior Publication Data

US 2015/0160599 A1 Jun. 11, 2015

(30) Foreign Application Priority Data

Dec. 5, 2013 (JP) ..... 2013-252124

(51) Int. Cl.

| | |
|---|---|
| ***G03G 15/08*** | (2006.01) |
| ***G03G 15/00*** | (2006.01) |
| ***G03G 15/16*** | (2006.01) |

(52) U.S. Cl.

CPC ..... *G03G 15/50* (2013.01); *G03G 15/1605* (2013.01); *G03G 15/161* (2013.01); *G03G 2215/0129* (2013.01)

(58) Field of Classification Search

CPC ..... G03G 15/556; G03G 15/0844
USPC ..... 399/257
See application file for complete search history.

(56) References Cited

U.S. PATENT DOCUMENTS

| | | | |
|---|---|---|---|
| 5,625,438 | A | 4/1997 | Sugiyama et al. |
| 5,625,441 | A | 4/1997 | Sugiyama et al. |
| 5,708,942 | A | 1/1998 | Sugiyama et al. |
| 5,845,183 | A | 12/1998 | Sugiyama et al. |
| 7,672,602 | B2 * | 3/2010 | Ariizumi et al. |
| 2008/0199223 | A1 | 8/2008 | Tateyama et al. |
| 2008/0213006 | A1 | 9/2008 | Nakayama et al. |
| 2009/0103954 | A1 | 4/2009 | Nakayama et al. |

(Continued)

FOREIGN PATENT DOCUMENTS

| | | |
|---|---|---|
| JP | 2001-075438 | 3/2001 |
| JP | 2006-171788 | 6/2006 |

(Continued)

*Primary Examiner* — Walter L Lindsay, Jr.
*Assistant Examiner* — Milton Gonzalez
(74) *Attorney, Agent, or Firm* — Oblon, McClelland, Maier & Neustadt, L.L.P.

(57) ABSTRACT

An image forming apparatus includes multiple image forming units each including a latent image bearer and a developing device, a transfer device to transfer toner images from the latent image bearers onto a surface of endless rotary member, a cleaner to clean the surface of the endless rotary member, and a control unit to execute a forcible toner consumption process to forcibly consume degraded toner stored in applicable one or more developing devices. The forcible toner consumption process includes a step of forming a toner image formed for forced consumption in a non-image region of the latent image bearer with an amount of toner corresponding to a difference between an image area ratio of a developed image and a prescribed threshold when the image area ratio of the developed image is lower than the prescribed threshold.

20 Claims, 7 Drawing Sheets

(56) References Cited

U.S. PATENT DOCUMENTS

| | | | |
|---|---|---|---|
| 2011/0211854 | A1 | 9/2011 | Shiori et al. |
| 2011/0229173 | A1 | 9/2011 | Nakayama |
| 2011/0229820 | A1 | 9/2011 | Higa |
| 2012/0027466 | A1 | 2/2012 | Nakayama et al. |
| 2012/0099878 | A1 | 4/2012 | Sukesako et al. |
| 2012/0237250 | A1 | 9/2012 | Higa |
| 2013/0236201 | A1 | 9/2013 | Mizutani et al. |
| 2014/0093286 | A1 | 4/2014 | Itoh |
| 2014/0341597 | A1* | 11/2014 | Urayama et al. |

FOREIGN PATENT DOCUMENTS

| | | |
|---|---|---|
| JP | 2009-058552 | 3/2009 |
| JP | 2010-020242 | 1/2010 |
| JP | 2013-109158 | 6/2013 |
| JP | 2013-190469 | 9/2013 |

* cited by examiner

IMAGE FORMING APPARATUS AND METHOD HAVING A FORCIBLE TONER CONSUMPTION PROCESS

CROSS-REFERENCE TO RELATED APPLICATION

This patent application is based on and claims priority pursuant to 35 U.S.C. §119(a) to Japanese Patent Application No. 2013-252124, filed on Dec. 5, 2013, in the Japan Patent Office, the entire disclosure of which is hereby incorporated by reference herein.

BACKGROUND

1. Technical Field

Embodiments of the present invention relate to an image forming apparatus and method that effectively conducts a forcible toner consumption process, in which a latent image formed for forced toner consumption is formed on a latent image bearer to force a developing device to consume degraded toner thereon.

2. Related Art

Conventionally, an image forming apparatus that forms an image by using an electrophotographic process is known. Specifically, after a latent image bearer such as a photoconductive drum, etc., is uniformly charged, an electrostatic latent image is formed thereon that is then developed by a developing device to obtain a toner image. The toner image is then transferred onto a recording medium (a recording sheet) from the latent image bearer either directly or indirectly via an intermediate transfer member.

In such a conventional system, when multiple images each having a low image area ratio are continuously formed for a long time, some toner in the developing device is only stirred without being consumed at the time. With this, additives either separate from or are embedded in surfaces of toner particles, thereby accelerating degradation of the toner. As degradation of the toner progresses, degradation of image quality also occurs simultaneously due to defective transfer, thereby generating a poor image, such as a scumming image (an image with toner adhering to a blank area), a void image, etc.

To suppress generation of such a poor image, a conventional image forming apparatus usually conducts a forcible toner consumption process. Specifically, when an image area ratio of an image having been most recently developed and outputted falls below a predetermined threshold, a toner image is formed on the photoconductive drum in a region thereof that corresponds to an interval between successive sheets of recording media (herein after sometimes simply referred to as a sheet interval corresponding region) using an amount of toner corresponding to a decreased level of the image area ratio to forcibly consume such toner in the developing device. Hence, by promoting consumption of the old toner and replacement with new toner in the developing device and thereby reducing a percentage of deteriorated toner in the developing device, generation of a poor image possibly caused by the degraded toner can be suppressed. Out of all region of the photoconductive drum in a circumferential direction thereof, the sheet interval corresponding region corresponds to an interval between successive sheets of recording media sent in a continuous printing mode to a transfer station.

In such a conventional image forming apparatus, the toner image is formed on the photoconductive drum and a drum cleaning unit is disposed surrounding the photoconductive drum to remove the toner from the photoconductive drum. However, the drum cleaning unit is there simply to clean the photoconductive drum by removing transfer residual toner that remains on the photosensitive surface in a toner image transfer process. Further, since an amount of toner in a toner image before the toner transfer process is far greater than an amount of toner remaining after the toner transfer process, the drum cleaning unit generally cannot remove all of the toner in the toner image formed for forced consumption alone. In particular, like in the former conventional image forming apparatus, since four photoconductive drums are disposed side by side to separately form yellow (Y), magenta (M), cyan (C), and black (K) color toner images, respectively, an individual drum cleaning unit needs to be compact to ease a layout of these drums. When it is attempted to remove all of the toner in the toner image formed for forced consumption only by using such a compact drum cleaning unit alone, various problems more likely arise due to defective cleaning.

According to another conventional image forming apparatus, four latent images formed for forced toner consumption are formed on four photoconductive drums of respective Y, M, C, and K colors and are developed and transferred onto an intermediate transfer belt at different positions thereof as the belt moves. Along with movement of the intermediate transfer belt, these four toner images of Y, M, C, and K colors each formed for forced consumption thereon are sent to a belt cleaning unit at different times from each other and are removed from the intermediate transfer belt.

SUMMARY

Accordingly, one aspect of the present invention provides a novel image forming apparatus that includes multiple image forming units each including a latent image bearer and a developing device to develop a latent image borne on the surface of the latent image bearer with toner. A transfer device is provided to transfer the toner images borne on the multiple latent image bearers either onto a recording sheet after transferring the toner images from the multiple latent image bearers onto a surface of endless rotary member or onto a recording sheet held on a surface of an endless rotary member directly. A cleaner is provided to clean the surface of the endless rotary member by removing transfer residual toner adhering thereto after a transfer process. A control unit is provided to execute a forcible toner consumption process to forcibly consume degraded toner stored in applicable one or more developing devices of the multiple image forming units by forming a toner image formed for forced consumption in a non-image region of the latent image bearer with an amount of toner corresponding to a difference between an image area ratio of a developed image and a prescribed threshold thereof when the image area ratio of the developed image is lower than the prescribed threshold. In the forcible toner consumption process, the control unit calculates a total consumption required amount of toner by adding together amounts of consumption required toner (in the respective image forming units) each calculated in accordance with the image area ratio of the developed image in each of the multiple image forming units. The control unit determines an amount of toner actually used to form a toner image for forced consumption in at least one of the multiple image forming units so that the total amount of actually used toner (in the respective image forming units) becomes less than a prescribed total maximum amount (determined in accordance with cleaning performance of the cleaner) when the total consumption required amount of toner exceeds the prescribed total maximum amount. The control unit reflects a difference between the amount of toner determined to actually adhere to the toner image formed for forced consumption so that the total amount of actually used toner (in the respective image forming units) becomes less than the prescribed total maximum amount and the consumption required amount of toner calculated in accordance with the image area ratio of the developed image in at least one of the multiple image forming units to a consumption required amount of toner to be calculated in the next forcible toner consumption process in one of the multiple image forming units. The toner image formed for forced consumption formed by the respective image forming units are transferred and superimposed on the endless rotary member.

Another aspect of the present invention provides a novel method of forming an image with multiple image forming units. The method includes the steps of: bearing latent images on surfaces of multiple latent image bearers; developing the latent images borne on the surfaces of the multiple latent image bearers with toner; transferring the toner images borne on the multiple latent image bearers either onto a recording sheet held on a surface of an endless rotary member or onto a recording sheet after transferring the toner images from the multiple latent image bearers onto a surface of endless rotary member; forming a toner image formed for forced consumption in a non-image region of the latent image bearer with an amount of toner corresponding to a difference between an image area ratio of a developed image and a prescribed threshold thereof when the image area ratio of the developed image is lower than the prescribed threshold (in each of the multiple image forming units to execute a forcible toner consumption process to forcibly consume degraded toner stored in each of the developing devices); calculating a consumption required amount of toner in accordance with the image area ratio of the developed image in each of the multiple image forming units; adding together each of the amounts of consumption required toner of the multiple image forming units to obtain a total consumption required amount of toner; determining a prescribed amount of toner actually adhering to the toner image formed for forced consumption to be formed in at least one of the multiple image forming units so that the total amount of actually used toner (in the respective image forming units) becomes less than a prescribed total maximum amount (determined in accordance with cleaning performance of the cleaner) when the total consumption required amount of toner exceeds the prescribed total maximum amount; reflecting a difference between the amount of toner determined to actually adhere to the toner image formed for forced consumption so that the total amount of actually used toner (in the respective image forming units) becomes less than the prescribed total maximum amount and the consumption required amount of toner calculated in accordance with the image area ratio of the developed image in at least one of the multiple image forming units to a consumption required amount of toner to be calculated in the next forcible toner consumption process in at least one of the multiple image forming units; transferring and superimposing the toner image formed for forced consumption formed by the respective image forming units on the endless rotary member; and cleaning the surface of the endless rotary member by removing transfer residual toner adhering thereto after transferring the toner images.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
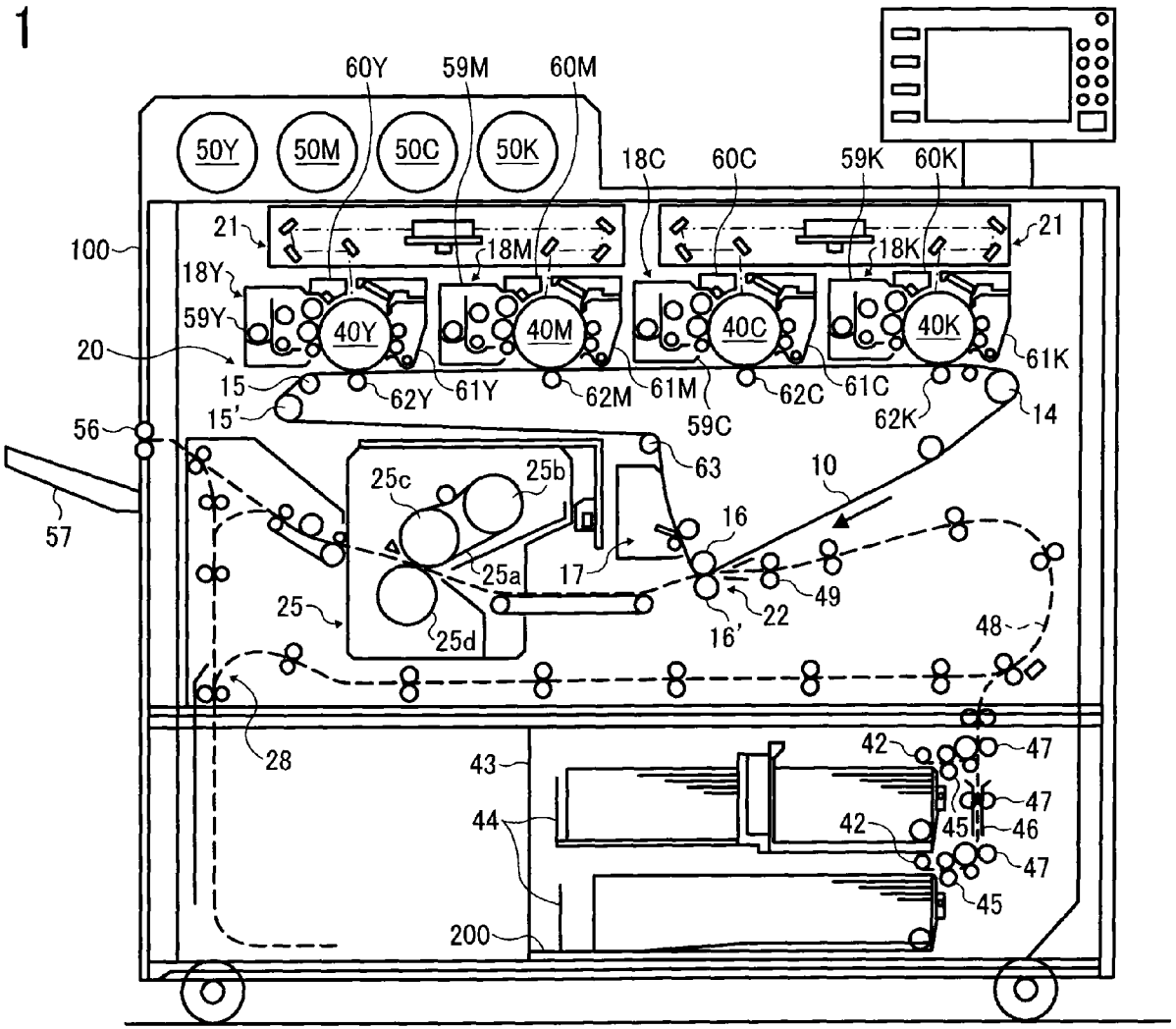
FIG. 1 is a diagram schematically illustrating an exemplary printer according to one embodiment of the present invention.

In a conventional image forming apparatus, occurrence of defective cleaning caused when removing the toner image formed for forced consumption can be suppressed because, different from a system with the drum cleaning unit, since a stretching posture of the intermediate transfer belt can be freely designed while disposing the belt cleaning unit therearound, a layout freedom is enhanced, and accordingly the belt cleaning unit can be relatively easily upsized. In addition, unlike the drum cleaning unit that cleans the photoconductive drum by removing transfer residual toner of one component color, the belt cleaning unit cleans the intermediate transfer belt by removing the transfer residual toner of four component colors at once.

For at least the above-described two reasons, then, the belt cleaning unit is generally designed to have better cleaning ability than the drum cleaning unit. That is, in the second conventional image forming apparatus, the belt cleaning unit having the better cleaning ability removes multiple toner images of Y, M, C, and K colors formed for forced consumption from the intermediate transfer belt. In addition, different from a system in which these color toner images on the intermediate transfer belt are transferred and superimposed (onto a transfer sheet) and subsequently sent to the drum cleaning unit simultaneously, instead these color toner images are transferred onto the intermediate transfer belt at different positions offset from each other and are separately sent to the drum cleaning unit (to be removed). With this, since the toner images of Y, M, C, and K colors each formed for forced consumption are removed by the belt cleaning unit within its cleaning ability, it is considered that generation of defective cleaning can be more effectively suppressed when compared with a system in which these toner images of Y, M, C, and K colors each formed for forced consumption are removed by the drum cleaning unit.

However, in the conventional image forming apparatus that removes the toner image formed for forced consumption with the belt cleaning unit in this way, a longer time is sometimes needed in a forcible toner consumption process depending on a choice of timing for forming the toner image for forced consumption.

In particular, for example, in the above-described first conventional image forming apparatus that executes formation of the toner image formed for forced consumption in a region of the photoconductive drum that corresponds to an interval between successive sheets of recording media. With such a configuration, when a toner image formed for forced consumption is entirely formed in the sheet interval corresponding region in each of the photoconductive drums of Y, M, C, and K colors, these toner images formed for forced consumption are unavoidably transferred and superimposed on the intermediate transfer belt. Accordingly, since these toner images of Y, M, C, and K colors each formed for forced consumption are sent to the belt cleaning unit simultaneously, an amount of toner exceeding the cleaning ability of the belt cleaning unit enters the belt cleaning unit resulting in defective cleaning.

To avoid the occurrence of such defective cleaning, the toner images of Y, M, C, and K colors each formed for forced consumption need to be transferred onto the intermediate transfer belt at deviated positions from each other in order. Thus, each of the toner image formed for forced consumption needs to be formed within a region below a quarter of the entire sheet interval corresponding region (at deviated positions) of each of the respective Y, M, C, and K color photosensitive drums. When the sheet interval corresponding region is set to an ordinary size, a prescribed amount of toner cannot appropriately adhere to the region below the quarter of the entire region thereof. Consequently, the sheet interval corresponding region needs to be more than the ordinary size to deal with the above-described problem. For this reason, a longer time is conventionally needed to perform the forcible toner consumption process.

Further, when the toner images of Y, M, C, and K colors each formed for forced consumption are transferred and superimposed on an endless intermediate transfer belt, etc., not to lengthen the forcible toner consumption process as described above, the belt cleaning unit is necessarily upsized thereby raising a cost because four times the cleaning ability is needed by a system in which these toner images are not superimposed on each other. The present invention is made in light of the above-described background and one aspect of the present invention provides a novel image forming apparatus which is capable of reducing occurrence of defective cleaning without lengthening a forcible toner consumption process and upsizing a cleaning unit to clean an endless rotary member when cleaning is executed by removing a toner image to be forcibly consumed. According to one embodiment of the present invention, occurrence of defective cleaning possibly caused when a toner image formed for forced consumption is removed can be reduced without enlarging a cleaning unit to clean an endless rotary member while not prolonging an operation time for executing a forcible toner consumption process.

Referring now to the drawings, wherein like reference numerals designate identical or corresponding parts throughout the several views thereof and in particular to FIG. 1, one embodiment of a xerographic printer as an image forming apparatus, to which the present invention is applied, is described. As there shown, a schematic block diagram illustrates a printer according to one embodiment of the present invention. Specifically, the printer 100 includes a sheet feeding unit (e.g., a sheet feeding table) to supply and feed multiple recording sheets housed therein toward a sheet feeding path and a printer mounted on the above this sheet feeding unit. Here, suffixes Y, M, C, and K attached following the signs in the drawing indicate members of yellow, cyan, magenta, and black colors, respectively.

Near a center of the printer, an endless intermediate transfer belt 10 as an endless rotary member is moveably wound clockwise in the drawing around multiple supporting rollers 14, 15, 15', 16, and 63. Out of the entire circumference of the intermediate transfer belt 10, a cleaning unit 17 contacts a front side of a belt portion wound around the cleaning backup roller. The cleaning unit 17 is provided to remove transfer residual toner remaining on the intermediate transfer belt 10 after passing through the secondary transfer nip as described later in detail.

Out of the entire circumference of the intermediate transfer belt 10, a horizontal region between the supporting rollers 14 and 15 is almost horizontally extended. Further, a tandem type image forming unit 20 is disposed above the horizontal region. In the tandem type image forming unit 20, four image forming units 18Y, 18M, 18C, and 18K for yellow, magenta, cyan, and black colors are disposed along the front surface of the belt while facing thereto, respectively.

Above the tandem type image forming unit 20, an optical writing device 21 is provided as a latent image writing device. Multiple image forming units 18Y, 18M, 18C, and 18K constitute the tandem type image forming unit 20 and include multiple photoconductive drums 40Y, 40M, 40C, and 40K as latent image bearers, on which respective latent images of yellow, magenta, cyan, and black colors are formed. Multiple surfaces of these photoconductive drums 40Y, 40M, 40C, and 40K are charged uniformly by electrical discharging devices 60Y, 60M, 60C, and 60Y, respectively, each to have a prescribed voltage (e.g., −650 V), and are then subjected to optical light scanning of the optical writing device 21 that drives a light source based on prescribed image data. Respective potentials generated on the surfaces of the photoconductive drums 40Y, 40M, 40C, and 40K by the optical scanning attenuate and become electrostatic latent images each having a prescribed voltage (e.g., −50 V), respectively.

These electrostatic latent images formed on the surfaces of the respective photoconductive drums 40Y, 40M, 40C, and 40K are developed and visualized by developing devices 59Y, 59M, 59C, and 59K, to be toner images of Y, M, C, and K colors, respectively. The respective developing devices 59Y, 59M, 59C, and 59K, are supplied with Y, M, C, and K toner particles from toner bottles 50Y, 50M, 50C, and 50K as needed, respectively. In the developing devices 59Y, 59M, 59C, and 59K, respective Y, M, C, and K toner particles and magnetic carriers are mixed and stirred with each other while collectively constituting Y, M, C, and K developing agents, respectively. Among the Y, M, C, and K developing agents, the Y, M, C, and K toner particles are negatively charged by friction each to have a prescribed amount of triboelectric charge (for example, about -30 μc/g). In the respective developing devices 59Y, 59M, 59C, and 59K, multiple developing rollers Y, M, C, and K colors are provided, respectively. Respective circumferences of the developing rollers of Y, M, C, and K colors are partially exposed to an outside through openings provided in multiple casings to face the photoconductive drums 40Y, 40M, 40C, and 40K, respectively. Respective Y, M, C, and K developing agents pumped up by the developing rollers of respective Y, M, C, and K colors, are conveyed up to multiple developing regions opposed to the photoconductive drums 40Y, 40M, 40C, and 40K as these rollers rotate, respectively. In the respective developing regions, developing potentials operate between the electrostatic latent images borne on the photoconductive drums 40Y, 40M, 40C, and 40K and the developing rollers to which respective developing biases (for example, about -500 V) are applied to move the toner particles each having negative polarity to these latent images from these rollers, respectively. With these developing potentials, respective Y, M, C, and K color toner particles on the developing rollers of Y, M, C, and K colors separate from the magnetic carriers and are transferred onto the latent images, respectively. With this, the electrostatic latent images borne on the photoconductive drums 40Y, 40M, 40C, and 40K are respectively developed and visualized by the Y, M, C, and K toner particles as the Y, M, C, and K toner images.

Below the respective photoconductive drums 40Y, 40M, 40C, and 40K, multiple primary transfer rollers 62Y, 62M, 62C, and 62K are disposed to press the intermediate transfer belt 10 against the photoconductive drums 40Y, 40M, 40C, and 40K, respectively. With this, multiple primary transfer nips, in which the photoconductive drums 40Y, 40M, 40C, and 40K and the intermediate transfer belt contact each other, are formed of respective Y, M, C, and K colors. Near the primary transfer nips of Y, M, C, and K colors, multiple primary transfer fields are formed between the primary transfer rollers 62Y, 62M, 62C, and 62K, to which multiple primary transfer bias voltages are applied, and the electrostatic latent images borne on the photoconductive drums 40Y, 40M, 40C, and 40K, respectively.

In the printer 100, when image data is received, the supporting roller 14 is rotated and driven by a driving device, not shown, to endlessly move the intermediate transfer belt 10 clockwise in the drawing. At the same time, the image forming units 18Y, 18M, 18C, and 18K are driven to form Y, M, C, and K toner images on the photoconductive drums 40Y, 40M, 40C, and 40K, respectively. These toner images are then primarily transferred and superimposed on a front surface of the intermediate transfer belt 10 in the primary transfer nips of Y, M, C, and K colors, respectively. With this, a four-color superimposed toner image is formed on the front surface of the intermediate transfer belt 10.

Here, when a black monochromatic image is simply formed on the intermediate transfer belt 10, the yellow, magenta, and cyan photoconductive drums 40Y, 40M, and 40C can be separated from the intermediate transfer belt 10 by moving the supporting rollers 15, 15' other than the driven supporting roller 14.

After passing through the primary transfer nips of Y, M, C, and K colors, transfer residual toner particles not having been primary transferred onto the intermediate transfer belt 10 generally adhere to the surfaces of the photoconductive drums 40Y, 40M, 40C, and 40K, respectively. These transfer residual toner particles, however, are removed by multiple drum cleaning units 61Y, 61M, 61C, and 61K from the surfaces of the photoconductive drums 40Y, 40M, 40C, and 40K and are conveyed toward multiple waste toner bottles, not shown, respectively.

After cleaning processes executed the above-described multiple drum cleaning units 61Y, 61M, 61C, and 61K, the surfaces of the photoconductive drum 40Y, 40M, 40C, and 40K are uniformly charged again by the electrical discharging devices 60Y, 60M, 60C, and 60K, respectively.

Subsequently, in the printer 100, one of the sheet feeding rollers 42 disposed above the sheet feeding table 200 in the sheet feeding unit is selectively rotated. With this, a recording sheet is launched from one of multi-tiered sheet feeding cassettes 44 established in a sheet bank 43. Subsequently, a separating roller 45 separates the recording sheets one by one and sends it toward a first sheet feeding path 46. A conveyor roller 47 then conveys and sends the recording sheet into a second sheet feeding path 48. The recording sheet entering the printer bumps against and stops at a registration nip formed between a pair of registration rollers 49.

Below the intermediate transfer belt 10, a secondary transfer system 22 is provided. In the secondary transfer system 22, out of the entire circumference of the intermediate transfer belt 10, a circumferential portion wound around a secondary transfer opposed roller 16 is contacted by a secondary transfer roller 16' to form a secondary transfer nip therebetween.

The pair of registration rollers 49 starts rotating and is driven at a prescribed time possible to stack the four-color superimposed toner image borne on the intermediate transfer belt on the recording sheet in a secondary transfer nip, and sends the recording sheet out toward the secondary transfer nip. In the secondary transfer nip, under the influence of a secondary transfer electric field and a nip pressure caused there, the four-color superimposed toner image borne on the intermediate transfer belt 10 is secondary transferred onto the recording sheet.

The recording sheet having passed through the secondary transfer nip is sent to a fixing device 25. The fixing device 25 includes a fixing belt unit and a pressing roller 25*d*. The fixing belt unit also includes a heating roller 25*b*, a fixing roller 25*c*, and a fixing belt 25*a* wound around these rollers to endlessly move, or the like. Here, the fixing belt 25*a* and the pressing roller 25*d* are contacted each other to form a fixing nip therebetween.

The endless fixing belt 25*a* includes a multilayer structure at least composed of a substrate layer made of prescribed material, such as nickel, stainless steel, polyimide, etc., and an elastic layer made of silicone rubber or the like laminated on a front surface of the substrate layer. A heating roller 25*b* is disposed inside a loop of the fixing belt 25*a* and is composed of a hollow roller made of metal such as aluminum, iron, etc., and a heat source, such as a halogen heater, etc., disposed inside the hollow roller.

The fixing belt 25*a* is endlessly moved clockwise in the drawing as the fixing roller 25*c* is driven and rotated while being stretched by the heating roller 25*b* and the fixing roller 25*c* disposed inside the loop thereof In this endlessly moving process of it, the endless fixing belt 25*a* is heated by the heating roller 25*b*.

Out of the entire circumference of the fixing belt 25*a*, the pressure roller 25*d* contacts a front side of a belt portion wound around the fixing roller 25*c*. When it is sent to and passes through the fixing nip of the fixing device 25, the recording sheet is heated and pressed to fuse the four-color superimposed toner image on the front surface thereof The recording sheet having passed through the fixing device 25 is discharged outside the image forming apparatus via a pair of sheet ejecting rollers 56 and is stacked on a sheet exit tray 57. Here, in a double-sided printing mode in which multiple images are formed on both sides of the recording sheet, the recording sheet with only a toner image on one side out of both sides thereof is sent to a retransmission unit 28 not to the pair of sheet ejecting rollers 56 after passing through the fixing device 25. Then, the retransmission unit 28 inverts front and rear sides of the recording sheet having only the toner image on one side thereof and transmits it toward the sheet feeding path 48 again. Subsequently, the recording sheet having only the toner image on one side thereof is sent to the secondary transfer nip from the sheet feeding path 48 and receives a four-color superimposed toner image on its second side in a secondary transfer process. The recording sheet having the toner images on both sides thereof is then exhausted outside the image forming apparatus via the fixing device 25 and the pair of sheet ejecting rollers 56.

When it has passed through the secondary transfer nip and the transfer residual toner sticking to the surface of it is removed by the belt cleaning unit 17, the intermediate transfer belt 10 again enters the primary transfer nips of respective Y, M, C, and K colors. Toner accommodated in the belt cleaning unit 17 may be collected by a toner conveying device, not shown, and is stored in a waste toner bottle, also not shown.

Figure 2:
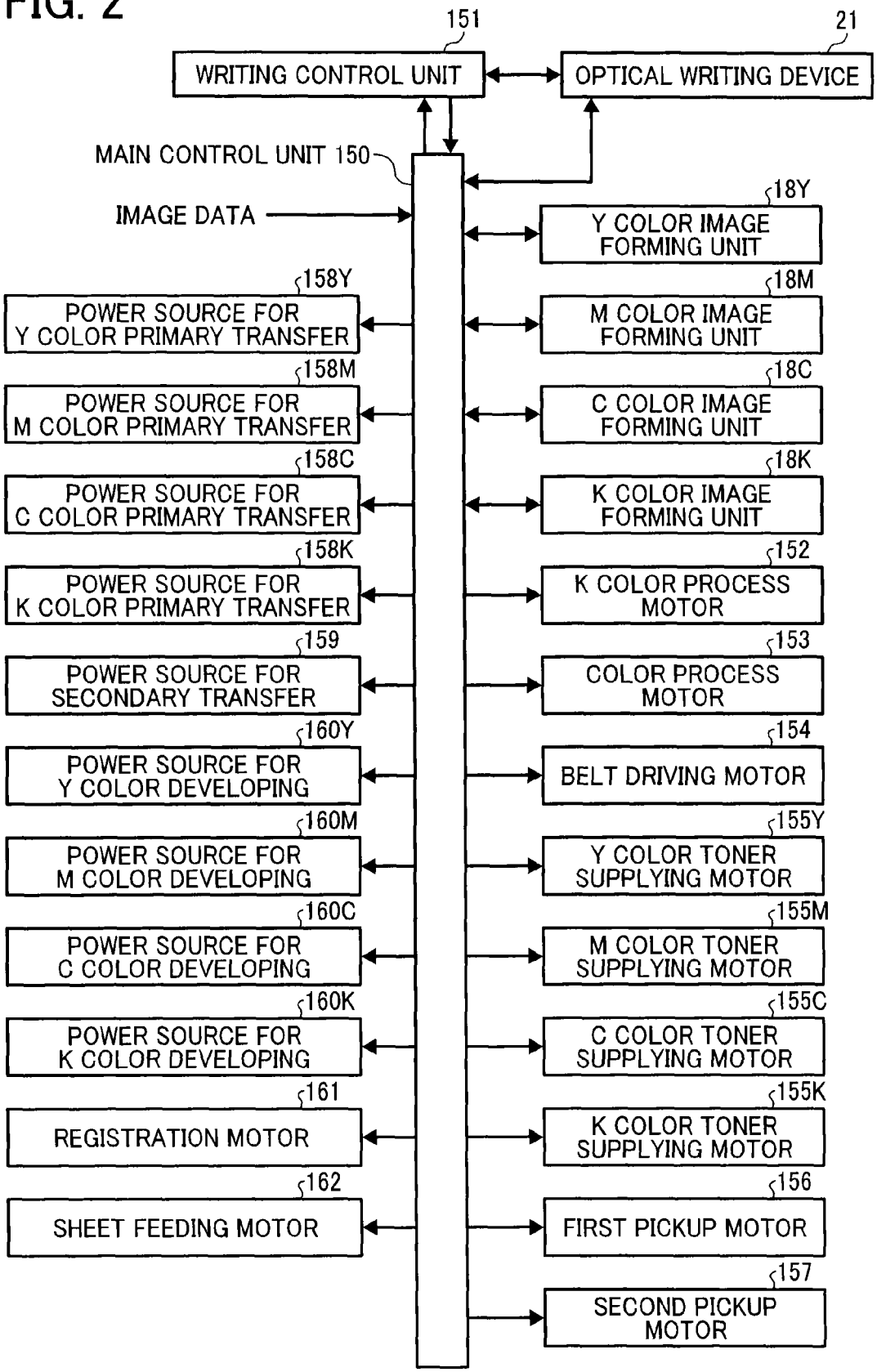
FIG. 2 is a block diagram schematically illustrating an essential portion of an exemplary electric circuit included in the printer of FIG. 1 according to one embodiment of the present invention.

Now, an essential portion of an electrical circuit employed in this printer is described with reference to a block diagram of FIG. 2. In the drawing, a writing control unit 151 drives and controls the optical writing device 21 to provide optical scanning to the photoconductive drums of respective Y, M, C, and K colors, not shown here, and writes electrostatic latent images thereon, respectively. A main control unit 150 includes a RAM (random access memory), a ROM (read only memory), a nonvolatile memory, and a CPU (central processing unit), etc., and performs various calculation processing operations while controlling driving of various devices. To the main control unit 150, the image forming units 18Y, 18M, 18C, and 18K of respective Y, M, C, and K colors, a K color process motor 152, and a color process motor 153 are connected. A belt driving motor 154, multiple toner supplying motors 155Y, 155M, 155C, and 155K of respective Y, M, C, and K colors, a first pickup motor 156, a second pickup motor 157, a registration motor 161, and a sheet feeding motor 162 are connected to the main control unit 150 as well. Multiple primary transfer power sources 158Y, 158M, 158C, and 158K of respective Y, M, C, and K colors, a secondary transfer power source 159, and multiple developing power sources 160Y, 160M, 160C, and 160K of respective Y, M, C, and K colors are also connected to the main control unit 150 as well.

The K color process motor 152 acts as a driving source for driving various devices such as the photoconductive drum, etc., employed in the image forming unit 18K of K color. The color process motor similarly acts as a driving source for driving various devices provided in the image forming units 18Y, 18M, and 18C of Y, M, and C colors. The belt driving motor 154 acts as a rotation driving source for rotating a roller that endlessly moves the intermediate transfer belt 10. These toner supplying motors 155Y, 155M, 155C, and 155K of respective Y, M, C, and K colors serve as driving sources that supply Y, M, C, and K color toner particles stored in the toner bottles of respective Y, M, C, and K colors to the developing devices 59Y, 59M, 59C, and 59K, respectively. A first pickup motor 156 serves as a driving source to send a recording sheet forward from one of two sheet feeding trays 44. A second pickup motor 157 also serves as a driving source to send a recording sheet forward from the other one of two sheet feeding trays 44. A registration motor 161 acts as a driving source to drive a pair of registration rollers 49. A sheet feeding motor 162 acts as a driving source to drive variety pair of transfer rollers disposed in the sheet feeding path. Multiple primary transfer power sources 158M, 158C, and 158K output and apply primary transfer biases to primary transfer rollers 62Y, 62M, 62C, and 62K of Y, M, C, and K colors, respectively. A secondary transfer power source 159 also outputs and applies a secondary transfer bias to the secondary transfer roller 16'. The developing power sources 160Y, 160M, 160C, and 160K also output and apply developing biases to developing rollers provided in the developing devices 59Y, 59M, 59C, and 59K of Y, M, C, and K colors, respectively.

The main control unit 150 controls driving of various types of devices based on image data coming from an external personal computer or the like upon receiving thereof. The main control unit 150 also sends image data to the writing control unit 151, for example, to form multiple toner images of Y, M, C, and K colors each formed for forced consumption as described later in detail. While controlling driving of the optical writing device 21 based on the image data, the writing control unit 151 sends the number of dots optically written to the main control unit 150 at prescribed time intervals per color of the respective Y, M, C, and K colors.

Further, the main control unit 150 implements a forcible toner consumption process either immediately after a printing job or during a continuous printing job of applicable one or more colors of Y, M, C, and K. When the forcible toner consumption process is executed during the continuous printing job, the main control unit 150 controls to form a toner image for forced consumption in a sheet interval corresponding region of applicable one or more photoconductive drums 40Y, 40M, 40C, and 40K of respective Y, M, C, and K colors as needed, respectively.

Figure 3:
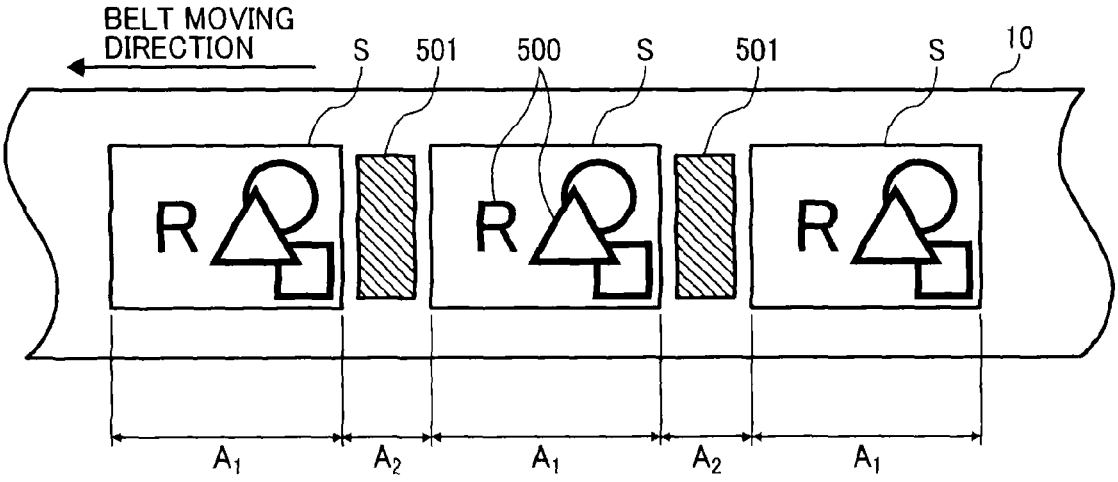
FIG. 3 is a diagram schematically illustrating an exemplary sheet interval corresponding region in an intermediate transfer belt created during a continuous printing job according to one embodiment of the present invention.

Now, a characteristic configuration of this printer is described in detail with reference to a planar diagram of FIG. 3. FIG. 3 schematically illustrates a sheet interval corresponding region defined during a continuous printing job on the intermediate transfer belt 10. In the drawing, a region A1 in the intermediate transfer belt 10 serves as a region in which an image 500 to be printed-out is formed and overlaps with a recording sheet S in a secondary transfer nip. A sheet interval corresponding region A2 not overlapping with a recording sheet S is provided on the intermediate transfer belt 10 between the sheet corresponding regions A1 and A1 which overlap with successive sheets of recording media S in the continuous printing job, respectively. With this, in the sheet interval corresponding region A2, as illustrated in the drawing, a toner image formed for forced consumption 501 is formed as needed. Although the sheet corresponding regions A1 and A1 and the sheet interval corresponding region A2 shown in the drawing are located on the intermediate transfer belt 10, a sheet corresponding region and a sheet interval corresponding region also similarly exist on each of the color photoconductive drums 40Y, 40M, 40C, and 40K of respective Y, M, C, and K colors. However, the sheet corresponding region of each of the photoconductive drums 40Y, 40M, 40C, and 40K of respective Y, M, C, and K colors, of course, does not overlaps with the recording sheet S. Herein below, the sheet corresponding region and the sheet interval corresponding region of the photoconductive drum are indicated as a sheet corresponding region Aa and a sheet interval corresponding region Ab, respectively.

The optical writing device 21 provides optical scanning light beams to respective regions of the photoconductive drums 40Y, 40M, 40C, and 40K each having an area So [$mm^2$] for 300 [ms]. The writing control unit 151 then outputs the number of dots optically written during the time to the main control unit 150 at every 300 [ms] for each color. The main control unit 150 seeks a write image area S by multiplying an area allocated) per one dot by the number of dots transmitted from the writing control unit 151. The main control unit 150 calculates a toner consumption amount M consumed when the write image area S is developed based on the below described formula; M [mg]=S [$mm^2$]'0.4 $mg/cm^2$÷100. Here, the second item 0.4 $mg/cm^2$ in the formula represents an amount of toner particles adhering to a toner image per unit area.

In this printer, when the image area ratio per unit area So [$mm^2$] is below a lower limit Co[%], a toner image formed for forced consumption is formed in a sheet interval corresponding region Ab on applicable one or more of the photoconductive drums 40Y, 40M, 40C, and 40K of respective Y, M, C, and K colors as needed. Herein below, the printer is described based on a definition that a lower limit consumption amount Mo represents an amount of toner consumed when a toner image is formed at the lower limit area ratio Co[%]. When having calculated a toner consumption amount M per unit area So [$mm^2$], the main control unit 150 compares it with the minimum consumption amount Mo. The main control unit 150 then calculates a consumption required amount of toner $R_1$ [mg] equivalent to a difference between the toner consumption amount M and the minimum consumption amount Mo. The minimum consumption amount Mo is previously sought by using the following expression; Mo [mg]=Co[%]× ((maximum writing width in a main scanning direction) 328mm×(line speed) 630 mm/s×(control cycle) 0.3 s))× (toner adhering amount per unit area) 0.400 $mg/cm^2$ ÷100. The main control unit 150 then calculates a consumption required amount of toner $R_1$ base on the following expression; (consumption required amount of toner) $R_1$=(consumption required toner cumulative amount until last time) Ro [mg]+ ((minimum consumption amount) Mo [mg]−(toner consumption amount) M [mg]).

Here, since a line speed of a photoconductive drum is about 630 mm/s, a surface of the photoconductive drum moves by about 189 [mm] for about 300 [ms]. In this printer, a length of a sheet interval corresponding region (of the photoconductive drum) in the sub-scanning direction generated in a continuous printing job is set to about 78 [mm]. When an A4-sized sheet (JIS) is longitudinally fed, since a length of the sheet in a conveying direction is about 297 [mm], the total length of the A4-sized sheet and the sheet interval corresponding region both in the conveying direction is about 375 [mm]. When the A4-sized sheet (JIS) is longitudinally fed, a consumption required amount of toner R1 is initially calculated for a first region on the photoconductive drum) having a longitudinal length of about 189 [mm] from a leading end corresponding to a tip of the A4-sized sheet, and is added to a consumption required toner cumulative amount Ro calculated last time. Secondly, the next consumption required amount of toner R1 is calculated for a second region on the photoconductive drum) extending from another position in the region corresponding to the precedent A4-sized sheet distanced by about 190 mm from the above-described leading end to a position in a region corresponding to the next A4-sized sheet distanced by about 3 mm from a leading end corresponding to a tip of the next A4-sized sheet through a remaining part of the region corresponding to the precedent A4-sized sheet having the longitudinal length of about 108 mm up to the rear end thereof and the sheet interval corresponding region A2 having the length of about 78 mm. Such a calculation result is similarly added to the consumption required toner cumulative amount Ro calculated last time. At this moment, accordingly, in a case where a toner image formed for forced consumption is formed in the sheet interval corresponding region Ab, the consumption required amount of toner R1 is calculated considering an image area ratio of the toner image formed for forced consumption as well. In many cases, an image area ratio exceeds the lower limit Co[%] due to formation of the toner image formed for forced consumption, and the toner consumption amount M [mg] also exceeds the minimum consumption amount Mo [mg]. For this reason, an item(Mo −M) in the below described formula is negative, and accordingly the consumption required cumulative amount Ro decreases; consumption required amount of toner) R1=(consumption required toner cumulative amount) Ro [mg]+(minimum consumption amount) Mo [mg]−(toner consumption amount) M [mg]). Also, in the sheet interval corresponding region Aa, when an image area ratio of an output image is high, since the item (Mo−M) is a negative value again, the consumption required toner cumulative amount Ro decreases. Accordingly, when a condition of a relatively high image area ratio of an output image continues, the consumption required toner cumulative amount Ro sometimes becomes a negative value.

Since a degradation degree of toner has a maximum amount, the toner particles do not deteriorate any more even when an image having a low image area ratio is continuously printed on a condition that outside additives of toner particles either entirely separate therefrom or are buried thereinto. When a degradation degree of toner stored in any one of the developing devices 59Y, 59M, 59C, and 59K, reaches the maximum amount and the entire toner is consumed forcibly, the degraded toner is also entirely discharged from the any one of the developing devices 59Y, 59M, 59C, and 59K. In this printer, however, each of the developing devices 59Y, 59M, 59C, and 59K is filled with an amount of about 1100 g of developing agent prepared by mixing toner and magnetic carrier with each other. Since a standard toner concentration of developing agent is set to about 7 [wt %], an amount of toner in each of the developing devices 59Y, 59M, 59C, and 59K amounts to about 77,000 [mg]. Accordingly, it is wasteful to forcibly consume a more amount of toner than about 77,000 [mg] at once. Therefore, the main control unit 150 determines and allocates a maximum amount consumption amount Rmax that represents a maximum amount of toner to be forcibly consumed at once to be about 77,000 [mg] for each of the image forming units 18Y, 18M, and 18C and 18K. A lower limit Rmin acting as a lower limit consumption amount is about 0 [mg].

As mentioned above, the length of the sheet interval corresponding region A2 in the sub-scanning direction is about 78 [mm]. However, when the toner image formed for forced consumption 501 is formed over the entire sheet interval corresponding region A2, front and/or rear ends of the recording sheet are possibly dirtied by toner of the toner image formed for forced consumption 501. Therefore, in this printer, a pair of margins each having about 54 [mm] are respectively formed in leading and trailing ends of the sheet interval corresponding region A2 to form the toner image formed for forced consumption 501 in a part of the sheet interval corresponding region A2 having a length of about 54 [mm]. Here, a cleaning ability of the belt cleaning unit 17 slightly declines at widthwise side ends of the intermediate transfer belt when compared with that at a center thereof. Therefore, the toner image formed for forced consumption 501 is formed in the widthwise center having a width of about 280 [mm]. The limit of (maximum) cleaning ability of the belt cleaning unit 17 is equivalent to about 0.800 mg/cm$^2$ when converted into an amount of toner (i.e., a removable amount of toner). When this limited (the maximum) amount of toner adheres to the region calculated by 54 [mm]×280 [mm], the total amount of toner is obtained by the following formula; 280×54×0.800÷100=121 [mg]. Hence, the main control unit 150 regards the solution 121 [mg] as a total maximum amount Emax and renders a total amount of toner adhering to a toner image formed for forced consumption 501 of each color to be less than the total maximum amount Emax.

Herein below, a consumption required amount of toner R1 for each of the respective Y, M, C, and K colors is referred to as R1y, R1m, R1c, and R1k. Similarly, the consumption required toner cumulative amount Ro for each of the respective Y, M, C, and K colors is herein below referred to as Roy, Rom, Roc, and Rok. The total of the amounts of consumption required toner R1y, R1m, R1c, and R1k (i.e., the total of the four colors Y, M, C, and K) is herein below referred to as the total consumption required amount of toner Rtotal.

Here, the main control unit 150 calculates each of the amounts of consumption required toner R1y, R1m, R1c, and R1k based on the numbers of dots of the Y, M, C, and K colors coming from the optical writing control unit 151, respectively, and further calculates the total consumption required amount of toner Rtotal by summing these values. The main control unit 150 then compares the above-described calculation result (i.e., the total consumption required amount of toner Rtotal) with the total maximum amount Emax. When an inequality Rtotal≤Emax is met, one or more applicable toner images 501Y, 501M, 501C, and 501K each formed for forced consumption are formed for respective Y, M, C, and K colors with the amounts of consumption required toner R1y, R1m, R1c, and R1k under control of the main control unit 150. At this moment (i.e., subsequently), a toner adhering amount per unit area M/A [mg/cm$^2$] is sought using an expression M/A=R1 [mg]÷(280 mm×54 mm÷100) for each color.

By contrast, when the inequality Rtotal>Emax is met, the total consumption required amount of toner Rtotal is equalized with the total maximum amount Emax. Hence, a toner image formed for forced consumption 501 is formed for at least one of the four colors Y, M, C, and K with an amount of toner equivalent to a provisional consumption amount R2 less than the consumption required amount of toner R1. In this printer, when all of the amounts of consumption required toner R1y, R1m, R1c, and R1k of four colors Y, M, C, and K is positive, four toner images formed for forced consumption 501 are formed with amounts of toner equivalent to the provisional consumption amounts R2y, R2m, R2c, and R2k, respectively. These provisional consumption amounts R2y, R2m, R2c, and R2k are set to be proportional to the amounts of consumption required toner R1y, R1m, R1c, and R1k, respectively. For example, when a ratio between the amounts of consumption required toner R1y, R1m, R1c, and R1k is about 1:2:3:4, a ratio between the provisional consumption amounts R2y, R2m, R2c, and R2k is set to about 1:2:3:4 as well. Then, the sum of these provisional consumption amounts R2y, R2m, R2c, and R2k is equalized with the total maximum amount Emax.

In this respect, the main control unit 150 seeks a toner adhering amount (the same as the provisional consumption amount R2) for each color using the following formula when the inequality Rtotal>Emax is met; M/A mg/cm$^2$=Emax [mg]×(R1÷Rtotal)÷(280 mm×54 mm÷100).

Hence, when respective toner adhering amounts of the toner images 501Y, 501M, 501C, and 501K each formed for forced consumption have been sought, a gradation realizing such a toner adhering amount is sought for each color base on the following expression; gradation N=the number of gradations 255×(M/A mg/cm$^2$±solid toner adhesion amount 0.400 mg/cm$^2$). Then, image data is sent to the writing control unit 151 to form the toner images 501Y, 501M, 501C, and 501K each formed for forced consumption with halftone patterns realizing the gradation N. The writing control unit 151 then controls the optical writing device 21 to write latent images to form the toner images 501Y, 501M, 501C, and 501K each formed for forced consumption in the sheet interval corresponding regions Ab on the respective photoconductive drums 40Y, 40M, 40C, and 40K. Here, an electric charging bias, a developing bias, and an optical writing intensity provided to the sheet interval corresponding region Ab are equalized with those provided to the sheet corresponding region Aa.

Although the above-described system adjusts the toner adhering amount with the half-tone N, the toner adhering amount can be adjusted by a different system from the half-tone N. For example, solid toner images are formed as the toner images 501Y, 501M, 501C, and 501K each formed for forced consumption while controlling an amount of toner adhering to each of electrostatic latent images thereof by adjusting a developing potential acting as a potential difference between the electrostatic latent image and the developing roller (for each color). For example, a consumption purpose developing potential Vpr acting as the developing potential used in a sheet interval corresponding region Ab is calculated based on a normal developing potential Vp used in the sheet corresponding region Aa. More specifically, the consumption purpose developing potential Vpr is sought by using the below described formula; Vpr [V]=Vp [V]×(M/A (mg/cm$^2$)±amount of toner adhering to solid toner image (0.400 mg/cm$^2$). Then, a consumption purpose electric charging bias Vdr acting as an electric charging bias used in the sheet interval corresponding region Ab is calculated based on a normal electric charging bias Vd used in the sheet corresponding region Aa. More specifically, the consumption purpose electric charging bias Vdr is sought by the below described formula; Vdr [V]=Vd [V]−(Vp [V]−Vpr [V]). A consumption developing bias Vbr acting as a developing bias used in the sheet interval corresponding region Ab is also calculated based on a normal developing bias Vb used in the sheet corresponding region Aa. More specifically, the consumption purpose developing bias Vbr is sought by using the below described formula, Vbr [V]=Vb [V]−(Vp [V]−Vpr [V]). A consumption purpose writing strength LDr[%] acting as an optical writing strength in the sheet interval corresponding region Ab is also calculated based on a consumption purpose electric charging bias Vdr. More specifically, the consumption purpose writing strength LDr[%] is sought by using the below described expression; LDr=0.125 [%/V]× Vdr [V]−6.25 [%]. The consumption purpose electric charging bias Vdr, the consumption purpose developing bias Vbr, and the consumption purpose writing strength Ldr sought in this way are applied to the sheet interval corresponding region Ab of the photoconductive drum (for each color).

Here, the normal electric charging bias Vd is switched to the consumption purpose electric charging bias Vdr when the sheet interval corresponding region Ab of the photoconductive drum is opposed to the electrical discharging device. By contrast, the consumption purpose electric charging bias Vdr is switched to the normal electric charging bias Vd when the sheet interval corresponding region Aa of the photoconductive drum is opposed to the electrical discharging device. The normal developing bias Vb is switched to the developing bias Vbr when the sheet interval corresponding region Ab of the photoconductive drum is opposed to the developing device. By contrast, the developing bias Vbr is switched to the normal developing bias Vb when the sheet interval corresponding region Aa of the photoconductive drum is opposed to the developing device.

When toner particles of the four Y, M, C, and K colors need to be forcibly consumed, multiple toner images 501Y, 501M, 501C, and 501K of respective Y, M, C, and K colors formed for forced consumption are formed and are primarily transferred at the primary transfer nips of respective Y, M, C, and K colors in order. Consequently, the toner images 501Y, 501M, 501C, and 501K each formed for forced consumption are ultimately superimposed on the intermediate transfer belt 10. The toner image formed for forced consumption 501 bearing the superposed toner images of four colors Y, M, C, and K then enters the secondary transfer nip. The main control unit 150 halts outputting of a secondary transfer bias, when the sheet interval corresponding region Al of the intermediate transfer belt enters the secondary transfer nip so that the toner image formed for forced consumption 501 is not reversely transferred from the belt onto the secondary transfer roller 16'. Although the above-described reverse transfer of the toner image formed for forced consumption 501 can be suppressed by stopping supply of the secondary transfer bias like the above, a slight amount of toner adheres to the secondary transfer roller 16'. However, the toner adhering to the secondary transfer roller 16' is removed by a secondary transfer roller cleaning unit, not illustrated, from the secondary transfer roller 16'.

Now, various experiments made by the inventors are described herein below. The 2 0 inventors have initially prepared a tester having the same configuration as the printer according to the above-described embodiment of the present invention (hereinafter referred to as a practical example tester). The inventors also have prepared a comparative example tester beside the above-described practical example tester. This comparative example tester is enabled to render an amount of toner adhering to each of the toner images 501Y, 501M, 501C, and 501K each formed for forced consumption of respective colors to be less than a quarter of the total maximum amount Emax. With this, the total consumption required amount of toner Rtotal can be suppressed to be less than the total maximum Emax even when the toner images of the four colors Y, M, C, and K each formed for forced consumption are piled up. However, when Y color is extraordinary highly required to be forcibly consumed while each of the remaining M, C, and K colors is almost never required, the toner image formed for forced consumption 501Y of Y color is simply formed with toner having the quarter of the total maximum amount Emax. Consequently, because three-quarters of the cleaning ability of the total maximum amount Emax is not used, the comparative example tester is inefficient.

Here, with each of the practical example tester and the comparative example tester, a printing test is carried out. Initially, Y and C dual color test images are continuously printed on 10,000 recording sheets. After that, another unit of 10,000 recording sheets is simply fed continuously without carrying images thereof Subsequently, C and K dual color test images are continuously printed on yet another unit of 10,000 recording sheets. Subsequently, Y and C dual color test images are continuously printed on yet another unit of 10,000 recording sheets. Hence, the total number of 40,000 recording sheets has been continuously printed consequently. However, it is to be noted that an M color image has not been outputted at all during the continuous printing job.

Figure 4A:
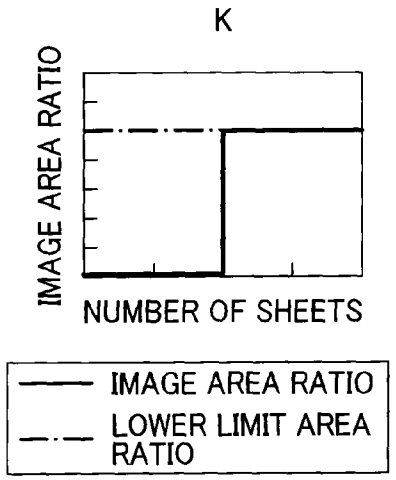
FIG. 4A is a graph schematically illustrating an exemplary relation between an image area ratio of K color and the number of printed sheets obtained in a printing test according to one embodiment of the present invention.
Figure 4B:
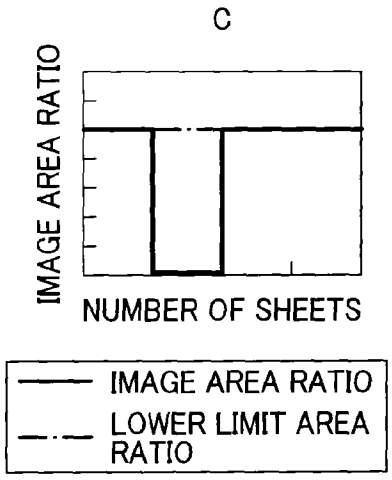
FIG. 4B is a graph schematically illustrating an exemplary relation between an image area ratio of C color and the number of printed sheets obtained in a printing test according to one embodiment of the present invention.
Figure 4C:
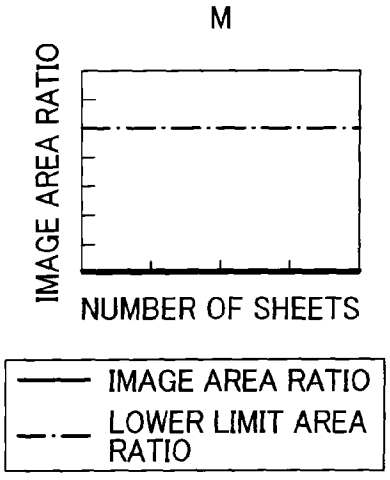
FIG. 4C is a graph schematically illustrating an exemplary relation between an image area ratio of M color and the number of printed sheets obtained in a printing test according to one embodiment of the present invention.
Figure 4D:
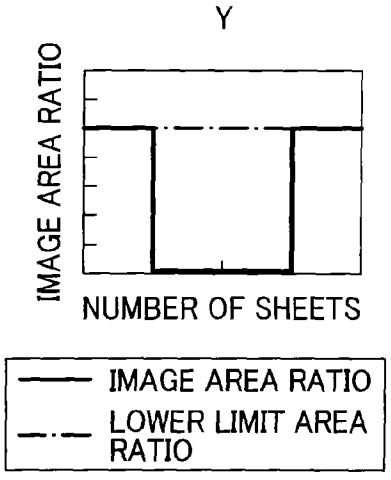
FIG. 4D is a graph schematically illustrating an exemplary relation between an image area ratio of Y color and the number of printed sheets obtained in a printing test according to one embodiment of the present invention.
Figure 5A:
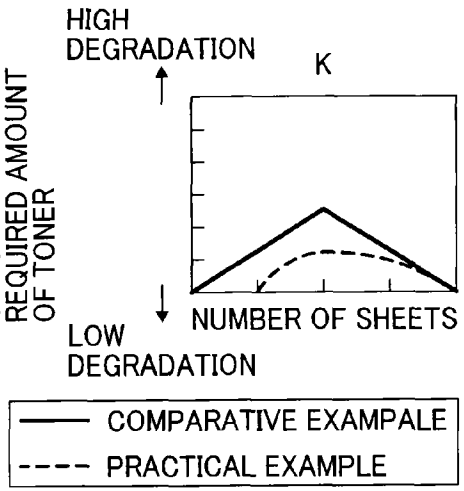
FIG. 5A is a graph schematically illustrating an exemplary relation between an accumulated consumption required amount of toner Rok of K color and the number of printed sheets obtained in a printing test according to one embodiment of the present invention.
Figure 5B:
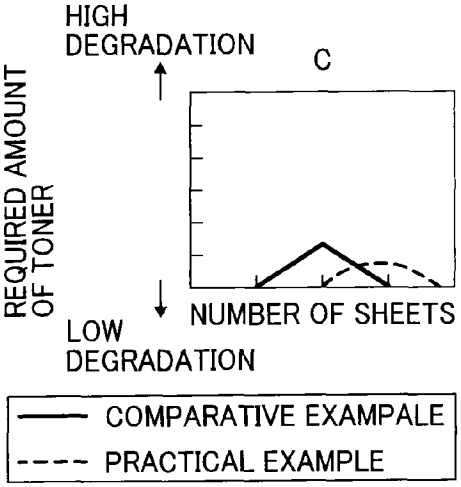
FIG. 5B is a graph schematically illustrating an exemplary relation between an accumulated consumption required amount of toner Roc of C color and the number of printed sheets obtained in a printing test according to one embodiment of the present invention.
Figure 5C:
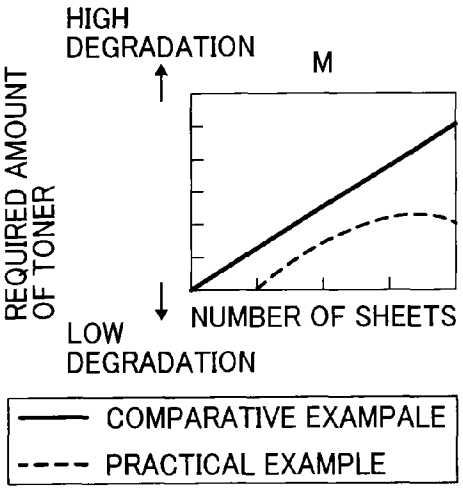
FIG. 5C is a graph schematically illustrating an exemplary relation between an accumulated consumption required amount of toner Rom of M color and the number of printed sheets obtained in a printing test according to one embodiment of the present invention.
Figure 5D:
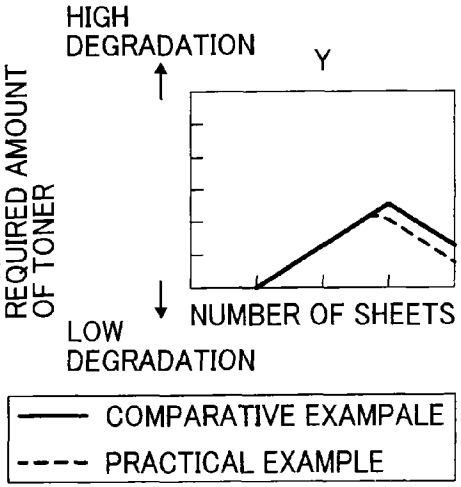
FIG. 5D is a graph schematically illustrating an exemplary relation between an accumulated consumption required amount of toner Roy of Y color and the number of printed sheets obtained in a printing test according to one embodiment of the present invention.

FIGS. 4A, 4B, 4C, and 4D are graphs respectively illustrating relations between image area ratios of respective K, C, M, or Y colors and the number of printing sheets obtained in the above-described printing test. As shown in FIG. 4A, during continuous printing from one to 20,000th recording sheets, the image area ratio of the K color becomes less than the lower limit ratio Co. As also shown in FIG. 4B, during continuous printing from 10,001th to 20,000th recording sheets, the image area ratio of the C color becomes less than the lower limit ratio Co. As also shown in FIG. 4C, during continuous printing from one to 40,000th recording sheets, the image area ratio of the M color becomes less than the lower limit ratio Co all the time. As yet also shown in FIG. 4D, during continuous printing from 10,001th to 30,000th recording sheets, the image area ratio of the Y color becomes less than the lower limit ratio Co. Accordingly, toner particles of four colors Y, M, C, and K are easily degraded in the below described relation in the above-described printing test; C<K=Y<M.

FIGS. 5A, 5B, 5C, and 5D are graphs respectively illustrating relations between consumption required toner cumulative amounts Rok, Roc, Rom, and Roy of the K, C, M, Y colors and the numbers of printing sheets obtained in the above-described printed test. As illustrated in the drawing, in any one of the K, C, M, and Y colors, the consumption required toner cumulative amounts Rok, Roc, Rom, and Roy obtained by the practical example tester are lower than those obtained by the comparative example tester. That is because, the practical example tester can forcibly consume a more amount of toner particles than the comparative example tester. Especially, the consumption required toner cumulative amounts Rom of the M color that provides the most difficult condition to suppress the degradation in the printing test by the practical example tester is significantly less than that in the printing test by comparative example tester. That is because, while suppressing the total consumption required amount of toner Rtotal to be less than the total maximum Emax, the practical example tester forcibly consumes an amount of toner particles of each color effectively in accordance with a requested level thereto.

Figure 6A:
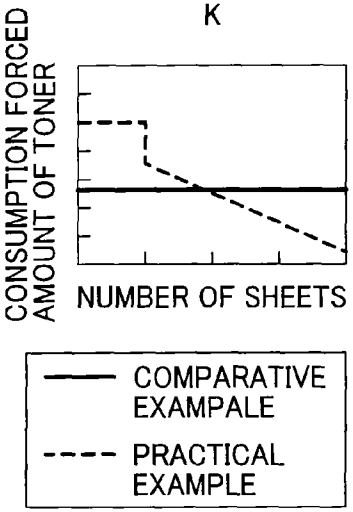
FIG. 6A is a graph schematically illustrating an exemplary relation between an amount of K color toner forcibly consumed and the number of printed sheets obtained in a printing test according to one embodiment of the present invention.

FIGS. 6A, 6B, 6C, and 6D are graphs respectively illustrating relations between amounts of forcibly consumed toner particles of K, C, M, Y colors and the numbers of printing sheets obtained in the above-described printed test. As shown in FIGS. 6A (and 6C), in a printing period of printing from first to 10,000th recording sheets, the practical example tester forcibly consumes a large amount of toner particles of K and M colors intensively. By contrast, the comparative example tester does not forcibly consume a large amount of toner particles of K and M colors intensively in the same printing period. This is because, as understood from FIGS. 4A, 4B, 4C, and 4D, neither the K color nor the M color is outputted to form respective color images in the same period, and accordingly, forcible toner consumption of those two colors of K and M are increasingly required as a result. In such a situation, the practical example tester forms toner image 501K and 501M of those two-colors formed for forced consumption each by attracting a half amount of toner particles of the total maximum amount Emax, thereby forcibly consuming color toner particles of those intensively. By contrast, since it forms toner image 501K and 501M of those two-colors each formed for forced consumption by attracting a quarter of the total maximum amount of toner particles Emax, the forcible toner consumption of the comparative example tester is less effective than that of the practical example tester.

Further, as shown in FIGS. 4A, 4B, 4C, and 4D again, in a printing period of printing from 10,001th to 20,000th recording sheets, none of color image is outputted, forcible toner consumption is increasingly required in each of the four colors Y, M, C, and K. In such a situation, as shown in FIGS. 6A, 6B, 6C, and 6D, both the practical example tester and the compare example tester form each of the toner images (of four colors) formed for forced consumption by attracting a quarter of the total maximum amount of toner particles Emax. Consequently, a difference in forcible toner consumption amount between the practical example tester and the compare example tester disappears in this situation.

Figure 6B:
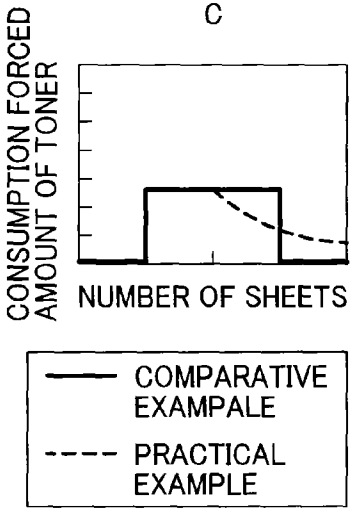
FIG. 6B is a graph schematically illustrating an exemplary relation between an amount of C color toner forcibly consumed and the number of printed sheets obtained in a printing test according to one embodiment of the present invention.

Further, as shown in FIGS. 4A, 4B, 4C, and 4D again, in a printing period of printing from 20,001th to $30,000^{th}$ recording sheets, although neither the M color image nor the Y color image is outputted during the printing period, the K and C color images are outputted. For this reason, the forcible toner consumption is increasingly requested in each of the M and Y colors. Although, the forcible toner consumption is not increasingly requested in each of the K and C colors, the comparative example tester forcibly consume the K and C color toner particles by the same amount with each other beside the M and Y color toner particles as well as shown in FIGS. 6A and 6B. This is because, the comparative example tester cannot forcibly consume the K and C toner particles only in the printing period of printing from 10,001th to 20,000th recording sheets, and the K and C toner particles continuously needs to be forcibly consumed also in the printing period of printing from 20,001th to 30,000th recording sheets (see FIGS. 5A and 5B). By contrast, as shown in FIGS. 6A and 6B, although the practical example tester forcibly consumes the K and C toner particles in the printing period of printing from 20,001th to 30,000th recording sheets, the amount thereof is dramatically fewer than that forcibly consumed in the comparative example tester.

Figure 6C:
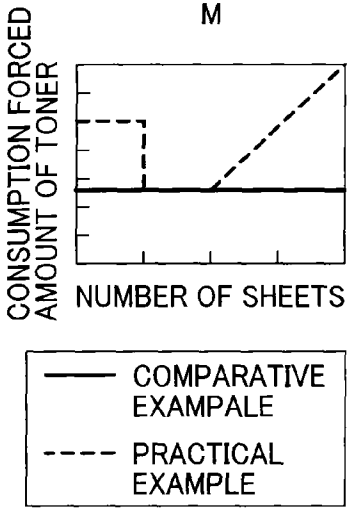
FIG. 6C is a graph schematically illustrating an exemplary relation between an amount of M color toner forcibly consumed and the number of printed sheets obtained in a printing test according to one embodiment of the present invention.
Figure 6D:
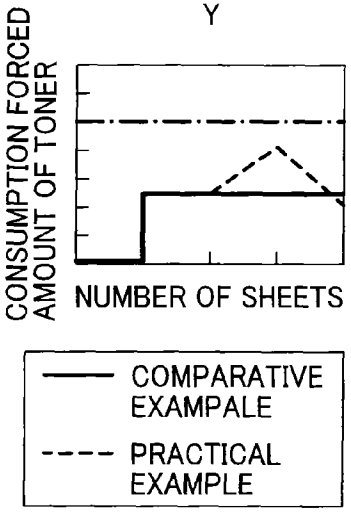
FIG. 6D is a graph schematically illustrating an exemplary relation between an amount of Y color toner forcibly consumed and the number of printed sheets obtained in a printing test according to one embodiment of the present invention.
Figure 7A:
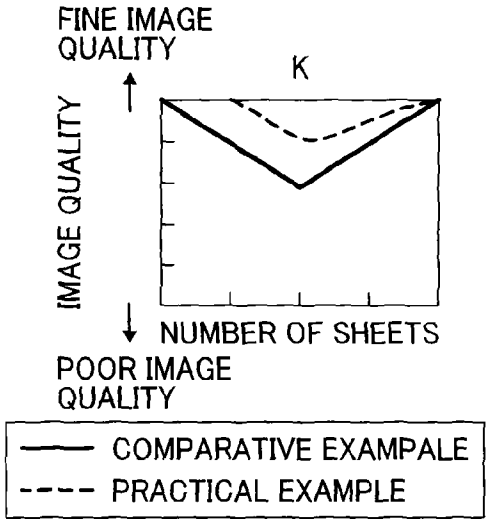
FIG. 7A is a graph schematically illustrating an exemplary relation between an image quality of K color and the number of printed sheets obtained in a printing test according to one embodiment of the present invention.
Figure 7B:
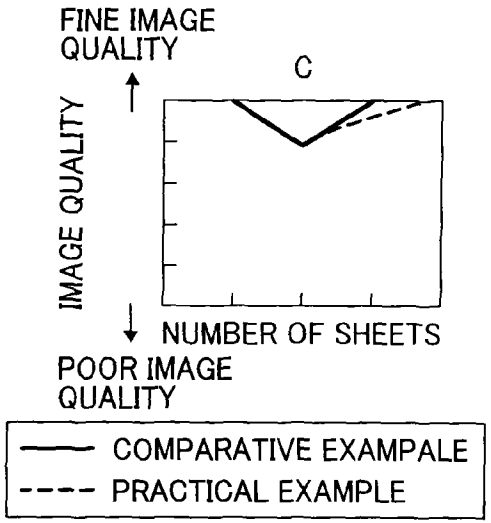
FIG. 7B is a graph schematically illustrating an exemplary relation between an image quality of C color and the number of printed sheets obtained in a printing test according to one embodiment of the present invention.
Figure 7C:
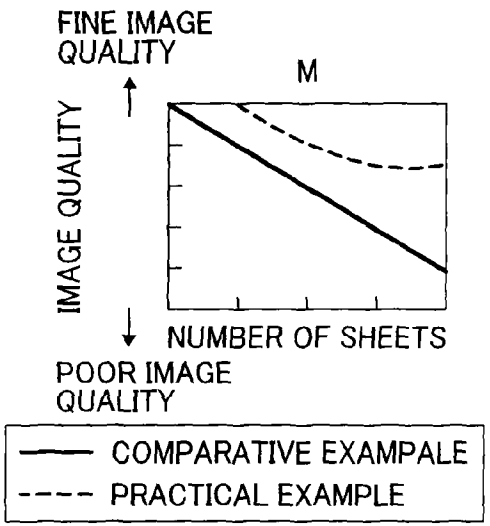
FIG. 7C is a graph schematically illustrating an exemplary relation between an image quality of M color and the number of printed sheets obtained in a printing test according to one embodiment of the present invention.
Figure 7D:
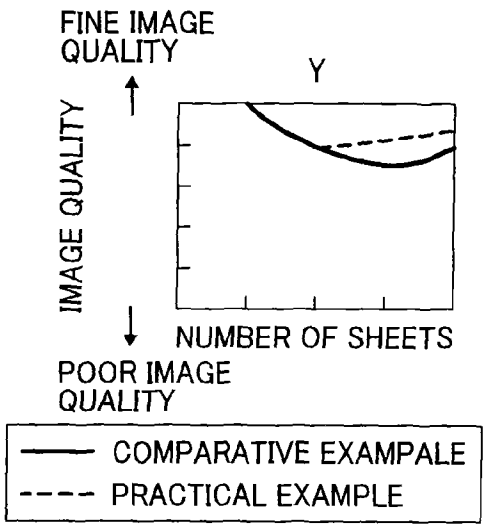
FIG. 7D is a graph schematically illustrating an exemplary relation between an image quality of Y color and the number of printed sheets obtained in a printing test according to one embodiment of the present invention.

As shown in FIGS. 4A, 4B, 4C, and 4D again, in a printing period of printing from 30,001th to 40,000th recording sheets, although the M color image is not outputted during the printing period, the other color images are outputted. For this reason, the forcible toner consumption of the M color is continuously highly requested as yet. At this moment, as shown in FIG. 6C, the practical example tester forcibly consumes a great amount of M color toner particles. Whereas, the comparative example tester forcibly consumes not great amount of M toner particles simultaneously. Because, although the practical example tester forms the toner image formed for forced consumption 501M of M color by attracting the same amount of toner as the total maximum amount Emax, the comparative example tester forms the toner image formed for forced consumption 501 M of M color by attracting a quarter of the total maximum amount of toner particles Emax.

Further, FIGS. 7A, 7B, 7C and 7D are graphs respectively illustrating relations between image qualities of the K, C, M, and Y colors and the numbers of printing sheets obtained in the above-described printed test, respectively. As shown in these drawings, it can be noted that the practical example tester more preferably suppresses the degradation of image quality possibly caused by the degradation of the toner when compared with the comparative example tester.

Heretofore, the printer using the intermediate transfer belt 10 as the surface endless moving member has been discussed as one example in the various embodiments of the present invention. However, the present invention can be also applied to an image forming apparatus having the following configuration as well. That is, the present invention can be applied to a system, in which a sheet conveyor belt is provided as a surface endless moving member, and multiple toner images borne on respective color photoconductive drums are transferred being superimposed on a recording sheet held on the surface of the endless moving member. In such a configuration, multiple toner images each formed for forced consumption may be superimposed on the surface of the sheet conveyor belt during a primary transfer process and are removed by a belt cleaning unit.

Although the embodiments described heretofore are just examples, and the present invention includes an inherent characteristic per embodiment as described herein below.

According to one aspect of the present invention, an image forming apparatus includes multiple image forming units each including a latent image bearer and a developing device to develop a latent image borne on the surface of the latent image bearer with toner. A transfer device is provided to transfer the toner images borne on the multiple latent image bearers either onto a recording sheet after transferring the toner images from the multiple latent image bearers onto a surface of endless rotary member or onto a recording sheet held on a surface of an endless rotary member directly. A cleaner is provided to clean the surface of the endless rotary member by removing transfer residual toner adhering thereto after a transfer process. A control unit is provided to execute a forcible toner consumption process to forcibly consume degraded toner stored in applicable one or more developing devices of the multiple image forming units by forming a toner image formed for forced consumption in a non-image region of the latent image bearer with an amount of toner corresponding to a difference between an image area ratio of a developed image and a prescribed threshold thereof when the image area ratio of the developed image is lower than the prescribed threshold. In the forcible toner consumption process, the control unit calculates a total consumption required amount of toner by adding together amounts of consumption required toner (in the respective image forming units) each calculated in accordance with the image area ratio of the developed image in each of the multiple image forming units. The control unit determines an amount of toner actually used to form a toner image for forced consumption in at least one of the multiple image forming units so that the total amount of actually used toner (in the respective image forming units) becomes less than a prescribed total maximum amount (determined in accordance with cleaning performance of the cleaner) when the total consumption required amount of toner exceeds the prescribed total maximum amount. The control unit reflects a difference between the amount of toner determined to actually adhere to the toner image formed for forced consumption so that the total amount of actually used toner (in the respective image forming units) becomes less than the prescribed total maximum amount and the consumption required amount of toner calculated in accordance with the image area ratio of the developed image in at least one of the multiple image forming units to a consumption required amount of toner to be calculated in the next forcible toner consumption process in at least one of the multiple image forming units. The toner images each formed for forced consumption by the respective image forming units are transferred and superimposed on the endless rotary member.

With such a configuration, since forcible consumption purpose toner images formed by multiple image forming units are transferred and superimposed on the endless rotary member, a time for executing a forcible toner consumption process does not take a long time as different from a system, in which toner images each formed for forced consumption are transferred being staggered with each other on the endless rotary member. Further, although a large amount of toner is sent to a cleaning unit at once on a prescribed condition thereby necessitating a larger cleaning unit, since the total consumption amount (i.e., an amount of toner adhering to a forcible toner consumption toner superimposed image) is limited to a prescribed level, occurrence of defective cleaning can be suppressed without upsizing the cleaning unit when the toner image formed for forced consumption is removed. Furthermore, due to implementation of a forcible toner consumption process using an amount of toner corresponding to a difference between an amount thereof determined not to exceed the total consumption amount and a consumption required amount of toner thereof at a different time (i.e., in the next time), occurrence of the above-described problem of upsizing can be avoided. Further, since forcible toner consumption is not intensively required in all of the image forming unit simultaneously unless an (abnormal) impossible printing job such as only continuous feeding of sheets without outputting image thereon, etc., is executed, and is usually partially required intensively, occurrence of a problem in that the forcible toner consumption by the corresponding amount to the above-described difference is not carried out indefinitely can be avoided. That is, the above-described forcible toner consumption can be carried out in the subsequent forcible toner consumption process by the corresponding amount to the difference.

According to another aspect of the present invention, the control unit executes the forcible toner consumption process at every printing as needed in a continuous printing mode in which an image is continuously formed on multiple recording sheets while forming the toner image for forced consumption in a sheet interval corresponding region of the latent image bearer in each of the multiple image forming units between image regions corresponding to preceding and succeeding transfer recording sheets in the surface moving direction thereof With such a configuration, the forcible toner consumption process can be executed while executing the continuous printing job without disrupting thereof According to yet another aspect of the present invention, the control unit determines amounts of toner adhering to the toner images each formed for forced consumption in the respective image forming units in accordance with a ratio between the amounts of consumption required toner in the respective image forming units. With such a configuration, degradation of image quality caused when the total consumption amount is reduced to be less than the total maximum amount can be likely avoided.

According to yet another aspect of the present invention, the control unit calculates and accumulates the consumption required amount of toner at a given interval, and then determines the amount of toner adhering to the toner image formed for forced consumption based on the accumulated amount of the consumption required amount of toner (for each of the respective image forming units). The control unit calculates the consumption required amount of toner negatively when the image area ratio is not less than the prescribed (threshold) minimum limit thereof. With such a configuration, an amount of toner can be forcibly consumed effectively in accordance with a degraded degree of toner (i.e., a forcible toner consumption requiring degree) only by employing an uncomplicated process, in which an image area ratio of a printed image is calculated at every given time and determines and accumulates a consumption required amount of toner based on the determination results thereof without differentiating an image formed based on the instruction of a user from a toner image formed for forced consumption.

According to yet another aspect of the present invention, the control unit calculates and allocates a consumption required amount of toner less than a prescribed maximum amount in the forcible toner consumption process (to applicable one or more image forming units). With such a configuration, a problem occurring when toner not degraded is wasted by excessively executing the forcible toner consumption more than a necessitated amount can be likely avoided.

According to yet another aspect of the present invention, a toner supply device is provided to supply toner to the developing device as needed, and the control unit controls the toner supply device not to supply toner to the developing device when the toner image formed for forced consumption is presently developed in each of the multiple image forming units. With such a configuration, a problem that toner just supplied to a developing device from the toner supply device contributes to a developing process for generating a toner image formed for forced consumption and is thereby forcibly consumed can be avoided.

According to yet another aspect of the present invention, the control unit adjusts the amount of toner adhering to the toner image formed for forced consumption by adjusting gradation thereof in the forcible toner consumption process. With such a configuration, an amount of toner adhering to a toner image formed for forced consumption can be preferably adjusted by adjusting gradation (of the toner image formed for forced consumption).

According to yet another aspect of the present invention, the control unit adjusts the amount of toner adhering to the toner image formed for forced consumption by adjusting a developing potential as a potential difference between an electrostatic latent image borne on the latent image bearer and the developing device in the forcible toner consumption process (executed in applicable one or more image forming units). With such a configuration, an amount of toner adhering to a toner image formed for forced consumption can be preferably adjusted by adjusting a developing potential (when developing toner image formed for forced consumption).

Numerous additional modifications and variations of the present invention are possible in light of the above teachings. It is therefore to be understood that within the scope of the appended claims, the present invention may be executed otherwise than as specifically described herein. For example, the image forming apparatus is not limited to the above-described various embodiments and may be altered as appropriate. Similarly, the image forming method is not limited to the above-described various embodiments and may be altered as appropriate. In particular, an order of various steps of the image forming method is not limited to the above-described various embodiments and may be altered as appropriate.

What is claimed is:

1. An image forming apparatus, comprising:

multiple image forming units each including a latent image bearer and a developing device to develop a latent image on a surface of the latent image bearer with toner;

a transfer device to transfer toner images on the multiple latent image bearers either onto a recording sheet after transferring the toner images from the multiple latent image bearers onto a surface of an endless rotary member or directly onto a recording sheet held on a surface of an endless rotary member;

a cleaner to clean the surface of the endless rotary member by removing transfer residual toner adhering thereto after a transfer process; and a controller to execute a forcible toner consumption process to forcibly consume degraded toner stored in one or more developing devices of the multiple image forming units by forming a toner image for forced consumption in a non-image region of the latent image bearer with an amount of toner corresponding to a difference between an image area ratio of a developed image and a prescribed threshold thereof when the image area ratio of the developed image is lower than the prescribed threshold, wherein, in the forcible toner consumption process, the controller calculates a total consumption required amount of toner by adding together amounts of consumption required toner in the respective image forming units each calculated in accordance with the image area ratio of the developed image in each of the multiple image forming units, wherein the controller determines an amount of toner actually used to form a toner image for forced consumption in at least one of the multiple image forming units so that the total amount of actually used toner in the respective image forming units becomes less than a prescribed total maximum amount, determined in accordance with cleaning performance of the cleaner, when the total consumption required amount of toner exceeds the prescribed total maximum amount, wherein the controller reflects a difference between the amount of toner determined to actually adhere to the toner image for forced consumption to enable the total amount of actually used toner in the respective image forming units to be less than the prescribed total maximum amount and the consumption required amount of toner calculated in accordance with the image area ratio of the developed image in at least one of the multiple image forming units to a consumption required amount of toner to be calculated in the next forcible toner consumption process in at least one of the multiple image forming units, wherein the toner images formed for forced consumption by the respective image forming units are transferred to and superimposed on the endless rotary member.

2. The image forming apparatus as claimed in claim 1, wherein the controller is configured to:

execute the forcible toner consumption process as needed at every printing in a continuous printing mode in which an image is continuously formed on multiple recording sheets; and execute the forcible toner consumption process in one or more image forming units by forming the toner image for forced consumption in a region of the latent image bearer corresponding to an interval between successive recording sheets.

3. The image forming apparatus as claimed in claim 2, wherein the controller determines amounts of toner adhering to the toner images formed for forced consumption in the respective image forming units in accordance with a ratio between the consumption required amounts of toner in the respective image forming units.

4. The image forming apparatus as claimed in claim 2, wherein the controller is configured to:

calculate and accumulate the consumption required amount of toner at a given interval, wherein the controller determines the amount of toner adhering to the toner image for forced consumption based on an accumulated consumption required amount of toner for each of the respective image forming units; and calculate the consumption required amount of toner negatively when the image area ratio is not less than a prescribed threshold minimum thereof.

5. The image forming apparatus as claimed in claim 1, wherein the controller is configured to calculate the consumption required amount of toner to be less than a prescribed maximum amount in the forcible toner consumption process in one or more image forming units.

6. The image forming apparatus as claimed in claim 1, further comprising a toner supply device to supply toner to the developing device as needed, wherein the controller directs the toner supply device not to supply toner to the developing device when the toner image for forced consumption is presently developed in each of the multiple image forming units.

7. The image forming apparatus as claimed in claim 1, wherein the controller adjusts the amount of toner adhering to the toner image for forced consumption by adjusting gradation thereof in the forcible toner consumption process.

8. The image forming apparatus as claimed in claim 1, wherein the controller adjusts the amount of toner adhering to the toner image for forced consumption by adjusting a developing potential as a potential difference between an electrostatic latent image on the latent image bearer and the developing device in the forcible toner consumption process executed in one or more image forming units.

9. A method of forming an image with multiple image forming units, comprising the steps of:

bearing latent images on surfaces of multiple latent image bearers;

developing the latent images on the surfaces of the multiple latent image bearers with toner;

transferring the toner images on the multiple latent image bearers either onto a recording sheet after transferring the toner images from the multiple latent image bearers onto a surface of an endless rotary member or directly onto a recording sheet held on the surface of the endless rotary member;

forming a toner image for forced consumption in a non-image region of each of the multiple latent image bearers with an amount of toner corresponding to a difference between an image area ratio of a developed image and a prescribed threshold thereof when the image area ratio of the developed image is lower than the prescribed threshold in each of the multiple image forming units to execute a forcible toner consumption process to forcibly consume degraded toner stored in each of the developing devices;

calculating consumption required amount of toner in accordance with the image area ratio of the developed image in each of the multiple image forming units;

adding together each of the amounts of consumption required toner of the multiple image forming units to obtain a total consumption required amount of toner;

determining a prescribed amount of toner actually adhering to the toner image for forced consumption to be formed in at least one of the multiple image forming units so that the total amount of actually used toner in the respective image forming units becomes less than a prescribed total maximum amount, determined in accordance with cleaning performance of the cleaner, when the total consumption required amount of toner exceeds the prescribed total maximum amount;

reflecting a difference between the amount of toner determined to actually adhere to the toner image for forced consumption so that the total amount of actually used toner in the respective image forming units becomes less than the prescribed total maximum amount and the consumption required amount of toner calculated in accordance with the image area ratio of the developed image in at least one of the multiple image forming units to a consumption required amount of toner to be calculated in the next forcible toner consumption process in at least one of the multiple image forming units;

transferring and superimposing the toner images for forced consumption formed by respective image forming units on the endless rotary member; and cleaning the surface of the endless rotary member by removing transfer residual toner adhering thereto after transferring the toner images.

10. The method as claimed in claim 9, wherein the step of forming a toner image for forced consumption is executed in a region of the latent image bearer corresponding to an interval between successive recording sheets in one or more image forming units as needed at every printing in a continuous printing mode in which an image is continuously formed on multiple recording sheets.

11. The method as claimed in claim 10, wherein the step of determining a prescribed amount of toner adhering to the toner image for forced consumption is executed in each of the image forming units in accordance with a ratio between the amounts of consumption required toner in the respective image forming units.

12. The method as claimed in claim 10, wherein the step of determining a prescribed amount of toner adhering to the toner image for forced consumption includes the sub-steps of:

calculating and accumulating a consumption required amount of toner at a given interval for each of the respective image forming units;

determining an amount of toner adhering to the toner image for forced consumption based on the accumulated amount of the consumption required amount of toner; and negatively calculating the consumption required amount of toner when the image area ratio is not less than the prescribed threshold minimum thereof.

13. The method as claimed in claim 9, wherein the step of calculating a consumption required amount of toner includes a sub-step of calculating a consumption required amount of toner to be less than a prescribed maximum amount in the forcible toner consumption process in one or more image forming units.

14. The method as claimed in claim 9, further comprising the steps of:

supplying toner to the developing device as needed; and directing the toner supply device not to supply toner to the developing device when the toner image formed for forced consumption is presently developed in each of the multiple image forming units.

15. The method as claimed in claim 9, further comprising the step of adjusting the amount of toner adhering to the toner image for forced consumption by adjusting gradation thereof in the forcible toner consumption process.

16. The method as claimed in claim 9, further comprising the step of adjusting the amount of toner adhering to the toner image for forced consumption by adjusting a developing potential as a potential difference between an electrostatic latent image on the latent image bearer and the developing device in the forcible toner consumption process executed in one or more image forming units.

17. An image forming apparatus, comprising:

means for forming multiple images with image forming means each including means for bearing a latent image on a surface thereof and means for developing a latent image on the surface of the latent image bearing means with toner;

means for transferring the toner images on the multiple latent image bearing means either onto a recording sheet after transferring the toner images from the multiple latent image bearing means onto a surface of an endless rotary means or directly onto a recording sheet held on a surface of an endless rotary means;

means for cleaning the surface of the endless rotary means by removing transfer residual toner adhering thereto after a transfer process; and control means for executing a forcible toner consumption process to forcibly consume degraded toner stored in one or more developing means of the multiple image forming means, the control means forming a toner image for forced consumption in a non-image region of the latent image bearing means with an amount of toner corresponding to a difference between an image area ratio of a developed image and a prescribed threshold thereof when the image area ratio of the developed image is lower than the prescribed threshold, wherein, in the forcible toner consumption process, the control means calculates a total consumption required amount of toner by adding together multiple amounts of consumption required toner in the respective image forming means each calculated in accordance with the image area ratio of the developed image in each of the multiple image forming means, wherein the control means determines an amount of toner actually adhering to the toner image for forced consumption to be formed in at least one of the multiple image forming means so that the total amount of actually used toner in the respective image forming units becomes less than a prescribed total maximum amount, determined in accordance with cleaning performance of the cleaning means, when the total consumption required amount of toner exceeds the total maximum amount, wherein the control means reflects a difference between the amount of toner determined to actually adhere to the toner image formed for forced consumption so that the total amount of actually used toner in the respective image forming units becomes less than the prescribed total maximum amount and the consumption required amount of toner to be calculated in accordance with the image area ratio of the developed image in at least one of the multiple image forming units to a consumption required amount of toner calculated in the next forcible toner consumption process in at least one of the multiple image forming units, wherein the toner images for forced consumption formed by the respective image forming means are transferred and superimposed on the endless rotary means.

18. The image forming apparatus as claimed in claim 17, wherein the control means is configured to:

execute the forcible toner consumption process as needed at every printing in a continuous printing mode in which an image is continuously formed on multiple recording sheets; and execute the forcible toner consumption process in an one or more image forming units by forming the toner image for forced consumption in a region of the latent image bearer corresponding to an interval between successive recording sheets.

19. The image forming apparatus as claimed in claim 18, wherein the control means determines amounts of toner adhering to the toner images for forced consumption in the respective image forming units in accordance with a ratio between the amounts of consumption required toners of the respective image forming units.

20. The image forming apparatus as claimed in claim 18, wherein the control means is configured to:

calculate and accumulate the consumption required amount of toner at a given interval, and determine the amount of toner adhering to the toner image for forced consumption based on the accumulated amount of the consumption required amount of toner for each of the respective image forming units; and calculate the consumption required amount of toner negatively when the image area ratio is not less than the prescribed threshold minimum thereof.

* * * * *